US005991579A

United States Patent [19]

Yu

[11] Patent Number: 5,991,579

[45] Date of Patent: Nov. 23, 1999

[54] HIGH SLOPE DC/AC COMBINATION CHARGING DEVICE

[75] Inventor: Zhao-zhi Yu, Webster, N.Y.

[73] Assignee: Xerox Corporation, Stamford, Conn.

[21] Appl. No.: 09/197,881

[22] Filed: Nov. 23, 1998

[51] Int. Cl.[6] ..... G03G 15/02

[52] U.S. Cl. ..... 399/170; 399/171

[58] Field of Search ..... 399/171, 170, 399/168, 223, 231; 250/324, 325, 326; 361/225, 229, 235

[56] References Cited

U.S. PATENT DOCUMENTS

| | | | |
|---|---|---|---|
| 5,258,820 | 11/1993 | Tabb | 399/296 |
| 5,537,198 | 7/1996 | Jackson | 399/168 |
| 5,539,501 | 7/1996 | Yu et al. | 399/171 |
| 5,579,100 | 11/1996 | Yu et al. | 399/39 |
| 5,581,330 | 12/1996 | Pietrowski et al. | 399/171 |
| 5,581,331 | 12/1996 | Teshigawara et al. | 399/171 |
| 5,600,430 | 2/1997 | Folkins et al. | 399/171 |

FOREIGN PATENT DOCUMENTS 58-156963 9/1983 Japan .

*Primary Examiner*—William Royer
*Assistant Examiner*—Sophia S. Chen
*Attorney, Agent, or Firm*—William Eipert

[57] ABSTRACT

A high slope charging device including a DC portion followed by an AC portion. The high slope device includes an insulative shell housing, an electrode and a corona wire. The electrode is coupled to direct current power source which supplies a constant potential to the electrode thereby generating a corona at the electrode. An alternating current power source supplies an alternating voltage to the corona wire. The high slope device beneficially is designed such that both the electrode and the corona wire charge a charge retentive surface to the same potential.

13 Claims, 5 Drawing Sheets

HIGH SLOPE DC/AC COMBINATION CHARGING DEVICE

BACKGROUND OF THE INVENTION

The present invention generally relates to corona generating devices and, more particularly, to a charging device having a DC portion followed by an AC portion for use in electrophotographic printing machines.

Electrophotographic marking is a well known and commonly used method of copying or printing documents. In general, electrophotographic marking employs a charge-retentive, photosensitive surface, known as a photoreceptor, that is initially charged uniformly. In an exposure step, a light image representation of a desired output focused on the photoreceptor discharges specific areas of the surface to create a latent image. In a development step, toner particles are applied to the latent image, forming a toner or developed image. This developed image on the photoreceptor is then transferred to a print sheet on which the desired print or copy is fixed.

The electrophotographic marking process outlined above can be used to produce black and white (monochrome) as well as color images. In general, color images are produced by repeating the electrophotographic marking process once for each color of toner used. Several methods exist for repeating the electrophotographic marking process to obtain color images. In one such method, the uniformly charged photoreceptor is initially exposed to a light image which represents a first color, such as black. The resulting electrostatic latent image is then developed with black toner particles to produce a black toner image. This same image area with its black toner layer is then recharged, exposed, and developed to produce a second color toner layer, such as yellow. This recharge/expose/and develop image on image (REaD IoI) development process may be repeated to subsequently develop images of different colors, such as magenta and cyan. The images may be formed by using a single exposure device, e.g. a raster output scanner (ROS), where each subsequent color image is formed in a subsequent pass of the photoreceptor (multiple pass). Alternatively, each different color image may be formed by multiple exposure devices corresponding to each different color image, during a single revolution of the photoreceptor (single pass).

In generating color images using the REaD IoI process the photoreceptor must be recharged to a substantially uniform level prior to the exposure and development of the next toner layer. When recharging the photoreceptor, it is important to level the voltages among the previously toned and untoned areas of the photoreceptor. While it may be possible to achieve voltage uniformity by simply recharging previously toned areas to the same voltage level as untoned areas, residual toner voltage complicates the process.

Residual toner voltage is the residual charge and the resultant voltage drop that exists across the toner layer of a developed (toned) area of the photoreceptor. The residual charge associated with previously developed toner images reduces the effective development field in the toned areas, affecting the consistency and desired uniformity of the developed mass of subsequent toner images. Color quality is severely threatened by the presence of the residual charge and the resultant voltage drop across the toner layer. The change in voltage due to the toned image can be responsible for color shifts, increased moire, increased color shift and toner spreading at image edges. The problem becomes increasingly severe with each additional toner layer due to the increased toner mass which must be neutralized prior to the exposure and development of the next toner layer.

Furthermore, recharging the photoreceptor becomes more difficult as the speed of the printing machine increases. To enable printing machines to increase the number of prints per minute, the speed at which the photoreceptor travels is typically increased. This increase in photoreceptor speed reduces the amount of time that a charging device acts upon the photoreceptor to recharge the photoreceptor and minimize the residual voltage associated with the toned areas.

The following references may be found relevant to the present disclosure.

U.S. Pat. No. 5,258,820 to Tabb discloses a multi-color printer wherein charged area images and discharged area images are created. An erase lamp is used following development of a charged area (CAD), and a pre-recharge corona device is used following development of a discharged area (DAD) and prior to a recharge step, to reduce voltage non-uniformity between toned and untoned images on a charge retentive surface.

U.S. Pat. No. 5,539,501 to Yu et al. discloses a corona generating device which includes a shell, a plurality of corona wires within the shell and a power source that outputs first and second alternating voltages which are out-of-phase with each other. The corona wires are connected to the power source such that the voltage received at each wire is out-of-phase with the voltage at adjacent wires.

U.S. Pat. No. 5,579,100 to Yu et al. discloses a recharging step employed between two image creation steps. The recharging step utilizes a corona generating device to recharge developed and untoned areas of a charge retentive surface to a lower potential than that associated with the developed areas before the recharge step.

U.S. Pat. No. 5,581,330 to Pietrowski et al. discloses a multi-color printing machine utilizing a recharge step between two image creation steps for conditioning a charge retentive surface pursuant to forming the second of the two images. The printing machine includes a voltage sensitive corona generating device having a high characteristic slope described in a graph of the current delivered to a charge receiving surface (I) vs. grid minus charge receiving surface voltage (V) to both reduce the residual toner voltage across the previously toned image, and to charge the toned and untoned areas of the charge retentive surface to a substantially uniform level.

U.S. Pat. No. 5,600,430 to Folkins et al. discloses a multi-color imaging apparatus utilizing a split recharge configuration wherein a first corona generating device recharges a charge retentive surface having a developed image thereon to a higher absolute potential than a predetermined potential, and then an alternating current second corona generating device recharges the surface to the predetermined potential.

SUMMARY OF THE INVENTION

In accordance with one aspect of the present invention, there is provided an apparatus for recharging a charge retentive surface which may include a developed image having an electrical charge associated therewith from an overcharged potential to a predetermined potential having a lower absolute potential than the overcharged potential. A DC charging device, positioned adjacent the charge retentive surface, reduces the potential of charge retentive surface to approximately the predetermined potential. An AC charging device, also positioned adjacent the charge retentive surface, neutralizes the electrical charge associated with the developed image.

In accordance with another aspect of the present invention, there is provided a printing machine including a charge retentive surface having a developed image thereon, the developed image having an electrical charge associated therewith. A corona generating device, positioned adjacent the charge retentive surface, recharges the charge retentive surface to an intermediate potential having a greater absolute potential than a final potential. A DC charging device, also positioned adjacent the charge retentive surface, recharges the charge retentive surface to the final potential. Next, an AC charging device recharges the charge retentive surface to the final potential and substantially neutralizes the electrical charge associated with the developed image.

In accordance with a further aspect of the present invention, there is provided a high slope charging device including a DC portion followed by an AC portion. The high slope device includes an insulative shell housing an electrode and a corona wire. The electrode is coupled to direct current power source which supplies a constant potential to the electrode thereby generating a corona at the electrode. An alternating current power source supplies an alternating voltage to the corona wire. The high slope device beneficially is designed such that both the electrode and the corona wire charge a charge retentive surface to the same potential.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

Figure 1:
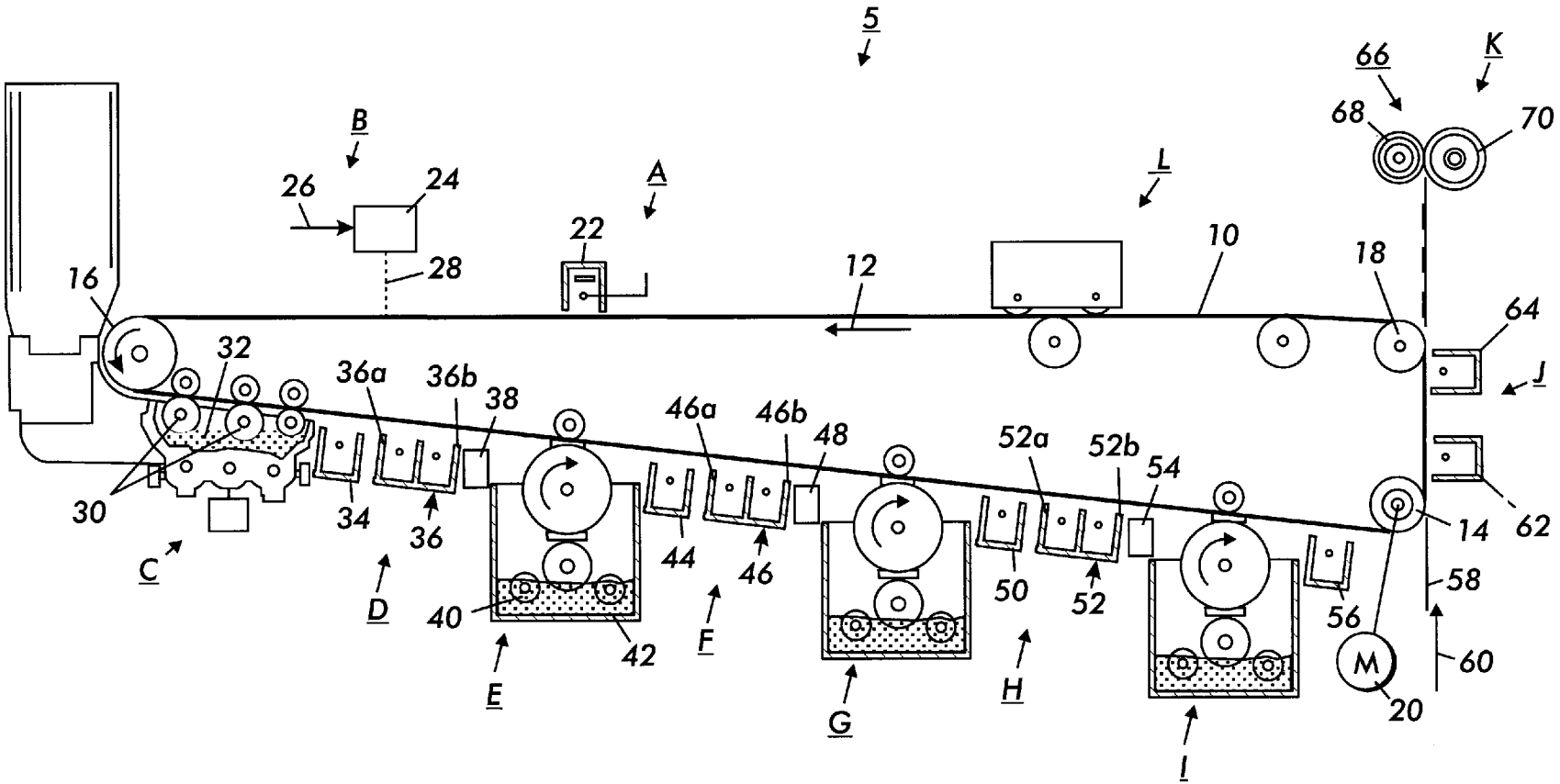
FIG. 1 is a schematic, elevational view of an electrophotographic printing machine which incorporates features of the present invention therein.

Referring to FIG. 1, there is shown an electrophotographic printing machine 5 which incorporates the features of the present invention. The printing machine 5 employs a charge retentive surface in the form of a photoreceptor belt 10 which travels sequentially through various process stations in the direction indicated by arrow 12. Belt 10 is entrained about drive roller 14 and tensioning rollers 16 and 18. Belt travel is brought about by rotating drive roller 14 via motor 20 coupled thereto. Printing machine 5 produces a color document in a single pass of photoreceptor belt 10 through the various processing stations disposed about the path thereof.

As belt 10 moves each part of it passes through each of the process stations described below. For convenience, a single section of photoreceptor belt 10, referred to as the image area, is identified. The image area is that part of photoreceptor belt 10 which receives the toner powder images that, after being transferred to a substrate, produce the final image. Photoreceptor belt 10 may have numerous image areas, each of which is processed in the same way.

Initially, the image area of photoreceptor belt 10 passes through charging station A, where a corona generating device 22, such as a corotron, a scorotron, a dicorotron, a discorotron, a pin scorotron or the like charges the photoconductive surface of belt 10 to a relatively high, substantially uniform potential. For purposes of example, the photoreceptor is negatively charged. However, it is understood that the present invention could be useful with a positively charged photoreceptor, by correspondingly varying the charge levels and polarities of the toners, recharge devices, and other relevant regions or devices involved in the REaD IoI color image formation process, as will be hereinafter described. In practice, this uniform potential is accomplished by charging the image area slightly more negative than −500 volts so that any resulting dark decay reduces the voltage to about −500 volts.

Upon passing through charging station A, the charged image area travels through a first exposure station B. At exposure station B, a modulated output generator such as raster output scanner (ROS) 24 receives image data signals 26 representing a first color (e.g., black) of a desired output image and generates modulated light beam 28 corresponding to the received image data. The image data signals 26 transmitted to ROS 24 may originate from a raster input scanner which captures an image from an original document or from a remotely located computer. Modulated light beam 28 illuminates portions of the image area which causes the charge retentive surface to be discharged so as to create an electrostatic latent image. Those portions of the image area exposed are discharged to about −50 volts. Thus, after exposure, the image area has a voltage profile comprised of high and low voltages corresponding to the charged and discharged areas.

After receiving an electrostatic latent image at exposure station B, the now exposed image area passes through a first development station C at which toner is placed on the latent image using commonly known techniques such as magnetic brush development, scavangeless development, or the like. Assuming development station C is of the type generally referred to as a magnetic brush developer, a plurality of magnetic brush rollers 30 advance negatively charged black toner 32 onto the image area. Toner 32 is attracted to the less negative sections of the image area and repelled by the more negative sections. The result is a first toner powder image on the image area.

After passing through development station C, the now exposed and toned image area passes to a first recharging station D. Recharging station D utilizes a split recharge configuration employing a pair of corona charging devices 34 and 36 which act together to adjust the voltage levels of both the toned and untoned parts of the image area to a substantially uniform level. A discussion of a split recharge method can be found in U.S. Pat. No. 5,600,430 to Folkins et al., the relevant portions of which are hereby incorporated by reference herein. Charging devices 34 and 36 substantially eliminate any voltage difference between toned and untoned parts, as well as reduce the level of residual charge remaining on the previously toned areas, so that subsequent development of different color toner images is effected across a uniform development field. Corona charging device 34 is beneficially the same as, or very similar to, corona generating device 22. Charging device 36 is a high slope charging device comprising a combination of a DC charging device **36*a* and an AC charging device 36*b***.

As the image area passes through recharging station D, corona generated in corona charging device 34 is transferred to the image area. Charging device 34 is designed to overcharge the image area and its toner particles to more negative voltage levels, such as −700 volts, than the desired voltage level that the image area and toner particles are to have when they leave recharging station D. However, because of differences in the charge characteristics of the untoned parts and the toned parts of the image area and the electrical charge associated with toner layer, the toned parts, while being charged to a level which is more negative than −500 volts, may not reach −700 volts.

After being charged by charging device 34, the image area passes the high slope charging device 36. Charging device 36 is designed to reduce the potential of both the untoned parts and the toned parts of the image area, to a desired potential of −500 volts. As the image area passes charging device 36, DC charging device 36*a* supplies positive ions to reduce the surface potential of both the toned and untoned parts of the image area to the desired potential of −500 volts. Next, AC charging device 36*b* operates to neutralize the charge associated with the toner layer as well as to ensure that the photoreceptor is uniformly charged at the desired potential. The high slope charging device 36 of the present invention is described in further detail with reference to FIGS. 2–6.

After being recharged at recharging station D, the now substantially uniformly charged image area with its first toner powder image passes to a second exposure station 38. Exposure station 38 is similar to exposure station B except that exposure station 38 illuminates the image area with a light representation of a second color image (such as yellow) to create a second electrostatic latent image. After this point, the image area contains toned and untoned parts at relatively high voltage levels (e.g. −500 volts) and toned and untoned areas at relatively low voltage levels (e.g. −50 volts). These low voltage areas represent image areas which are to be developed using yellow color toner.

After being exposed at the second exposure station 38 the image area passes to a second development station E. At development station E toner 40 which is of a different color (such as yellow) than the toner 32 in development station C is advanced onto the second latent image. Toner 40 which is contained in developer housing 42 beneficially is advanced onto the latent image by a non-interactive developer such as a scavengeless developer such previously deposited toner layers are not disturbed. After passing through development station E the image area has first and second toner powder images which may overlap.

After passing through development station E the image area passes to a second recharging station F. Recharging station F has first and second charging devices, devices 44 and 46 that operate in the same manner as the charging devices 34 and 36 described above. Briefly, charging device 44 is a corona generating device similar to corona generating devices 22 and 34 which overcharges the image areas to a greater absolute potential than that ultimately desired. Charging device 46 operates in the same manner as the high slope charging device 36 described above to neutralize the overcharged image area such that both the toned and untoned parts of the image area are at a substantially uniform level. That is, charging device 46 comprises a DC charging device 46*a* that reduces the surface potential of both the toned and untoned parts of the image area to the desired potential and an AC charging device 46*b* that neutralizes the charge associated with the toner layer.

After passing through recharging station F the recharged image area passes through a third exposure station 48. Except for the fact that the third exposure station illuminates the image area with a light representation of a third color image (such as magenta) so as to create a third electrostatic latent image, exposure station 48 is the same as the first and second exposure stations B and 38. The third electrostatic latent image is then developed using a third color toner (e.g., magenta) at a third development station G. Development station G is beneficially a scavengeless development system similar to development station E.

After passing through developer station G the image area passes through a third recharging station H. Recharging station H includes a pair of corona charging devices 50 and 52 which adjust the voltage level of both the toned and untoned parts of the image area to a substantially uniform level in the same manner as charging devices 34 and 36 and charging devices 44 and 46. Briefly, charging device 50, which is similar to charging devices 34 and 44, overcharges the image areas to a greater absolute potential than the ultimately desired potential. Next, charging device 52 operates in the same manner as charging devices 36 and 46 described above to recharge both the toned and untoned parts of the image area to a uniform potential and to neutralize toner voltage. Device 52 employs a DC charging device 52*a* in combination with a high slope AC charging device 52*b*.

After passing through recharging station H the recharged image area passes through a fourth exposure station 54. Except for the fact that exposure station 54 illuminates the image area with a light representation of a fourth color image (say cyan) so as to create a fourth electrostatic latent image, exposure station 54 is beneficially the same as the first, second, and third exposure stations, the exposure stations B, 38, and 48, respectively. The fourth electrostatic latent image is then developed using a fourth color toner (cyan) at a fourth development station I. Development station I is beneficially a scavengeless development system similar to the second development station E and to the third development station G.

To condition the toner for effective transfer to a substrate, the image area then passes to a pre-transfer corotron device 56 which delivers negative corona to ensure that all toner particles are of the required negative polarity. Pre-transfer corotron device 56 is preferably a device or devices similar to the corona generating device 22. After passing pre-transfer device 56, the four toner powder images are transferred from the image area onto a support sheet 58 at transfer station J. It is to be understood that support sheet 58 is advanced to the transfer station in the direction of arrow 60 by a conventional sheet feeding apparatus (not shown). Transfer station J includes a transfer corona device 62 which sprays positive ions onto the backside of sheet 58. This causes the negatively charged toner powder images to move onto sheet 58. The transfer station J also includes a detach corona device 64 which facilitates the removal of support sheet 58 from the printing machine 5 after image transfer.

After transfer, support sheet 58 moves onto a conveyor or similar sheet handling device (not shown) which advances the sheet to fusing station K Fusing station K includes fuser assembly 66 which permanently affixes the transferred powder image to support sheet 58. Preferably, fuser assembly 66 includes a heated fuser roller 68 and a heated pressure roller 70. When support sheet 58 passes between fuser roller 68 and pressure roller 70 the toner powder is permanently affixed to the sheet. After fusing a chute or similar sheet transfer system (not shown) guides support sheet 58 to an output tray (also not shown).

After support sheet 58 has separated from the photoreceptor belt 10, residual toner particles remaining on the image area are removed at cleaning station L. Cleaning station L may include a fibrous brush and/or a cleaning blade to disturb and remove paper fibers and loose toner particles from the belt. The image area is then ready to begin a new cycle at charging station A. The various machine functions described above are generally managed and regulated by a controller (not shown) which provides electrical command signals for controlling the operations described above.

Figure 2:
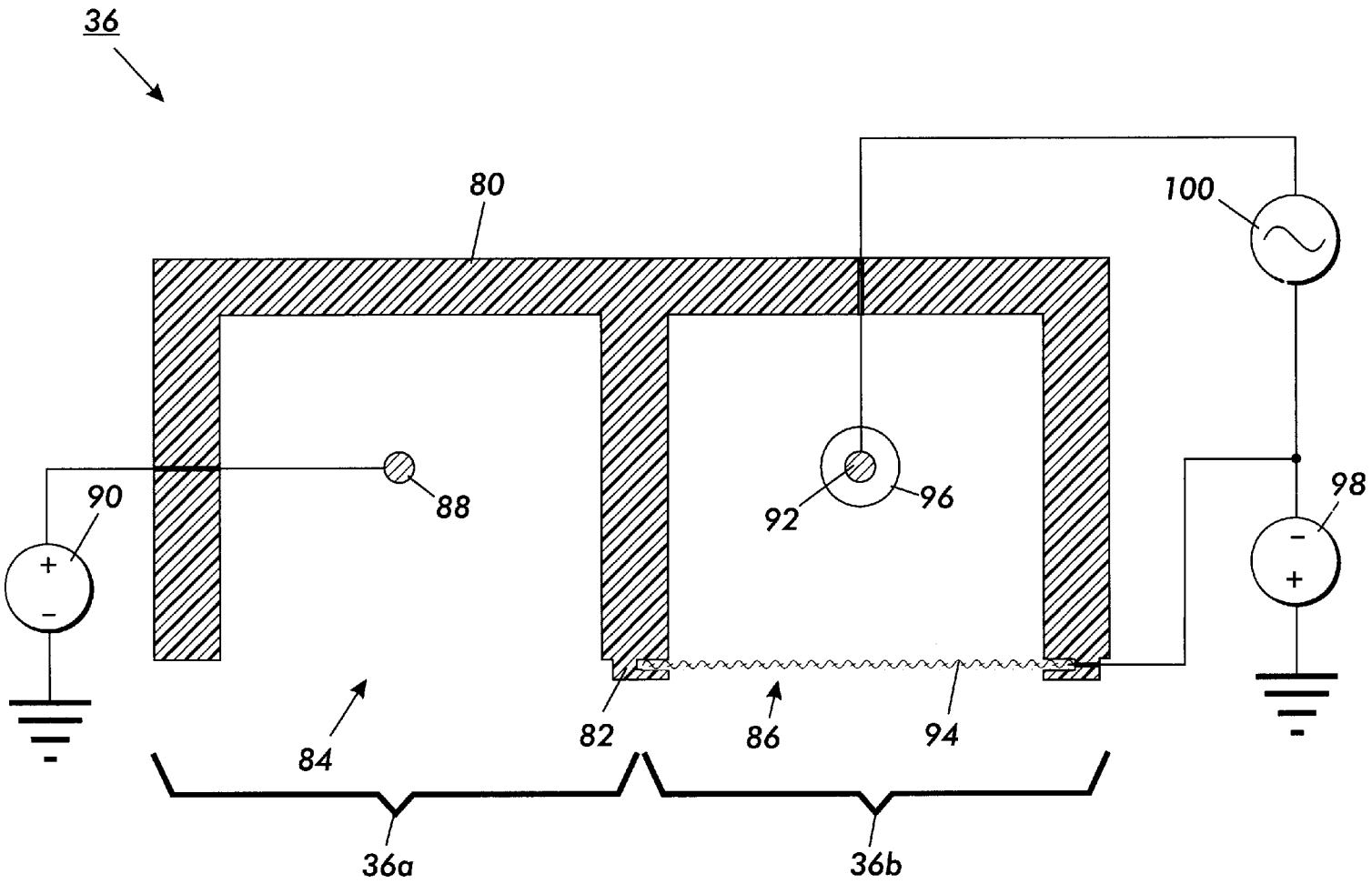
FIG. 2 is a sectional, elevational view illustrating an embodiment of a charging apparatus in accordance with the principles of the present invention.

Referring now to FIG. 2, there is shown a high slope DC/AC charging device 36 in accordance with the present invention. As shown, device 36 includes an insulative shell 80 having an inner wall 82 dividing the shell into chambers 84 and 86 corresponding to charging devices 36*a* and 36*b*, respectively. DC charging device 36*a* includes chamber 84 housing electrode 88 coupled to a voltage source 90. AC charging device 36*b* includes chamber 86, corona wire 92 and grid 94. Beneficially, corona wire 92 is coated with a dielectric material 96 such as glass. Voltage source 98 maintains grid 94 at a constant potential and power source 100 provides an alternating voltage to corona wire 92.

Figure 3:
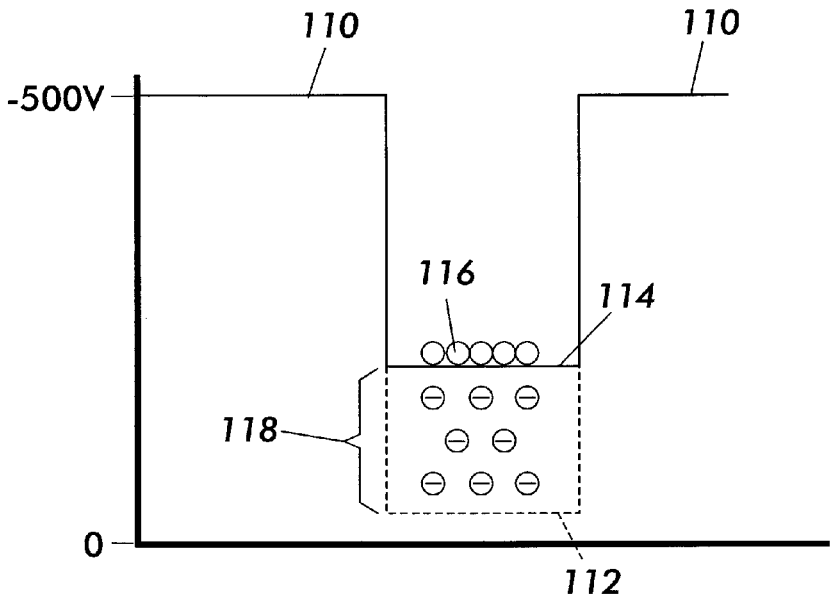
FIGS. 3–6 illustrate voltage profiles of an image area at various stages during a recharging step employing the charging apparatus of the present invention.
Figure 4:
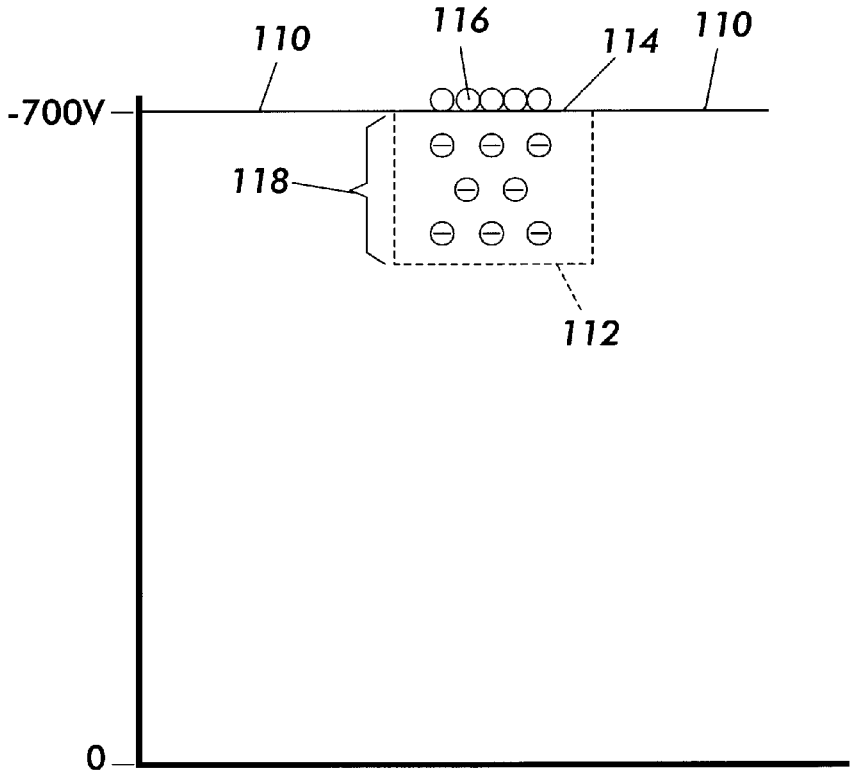

The operation of the device of FIG. 2 will be described with additional reference to FIGS. 3–6. Briefly reviewing, the voltage profile of the image area upon entering a recharging station, such as recharging station D, is shown in FIG. 3. The charge on the photoreceptor for those parts of the image area that were not exposed to the modulated light beam (untoned parts 110) remains at the original potential of −500 volts (after dark decay). Although those areas of the photoreceptor that were exposed to the beam have been discharged to approximately −50 volts (indicated by dotted line 112), the potential at the surface of the toned parts 114 of the image area is increased after the application of toner particles 116 which have a negative charge (residual voltage 118) associated therewith. At the recharging station, first corona charging device 34 overcharges the image area such that the potential at the untoned parts 110 and toned parts 114 of the image area is at a negatively higher level than the original potential of −500 volts. FIG. 4 shows the potential at the surface of the image area being charged to approximately −700 volts. As can be seen from FIG. 4, toner 116 retains a relatively large negative charge (residual voltage 118).

After passing through the first corona charging device 34 the image area, having the voltage profile shown in FIG. 4, advances to corona charging device 36. At corona charging device 36, the image area first encounters direct current charging device 36*a*. At DC charging device 36*a*, voltage source 90 provides a constant potential to electrode 88 thereby generating a corona at the electrode. Given that the image area is negatively charged, device 36*a* is designed to generate and deliver positive ions to the image area. The positive ions generated at the corona surrounding electrode 88 are delivered to the image area, thereby reducing the charge on the photoreceptor. As charging device 36*a* is a direct current device generating only one type of ion (positive), all of the ions produced by the device can be used to recharge the photoreceptor. Thus, charging device 36*a* quickly and efficiently charges the image area.

Figure 5:
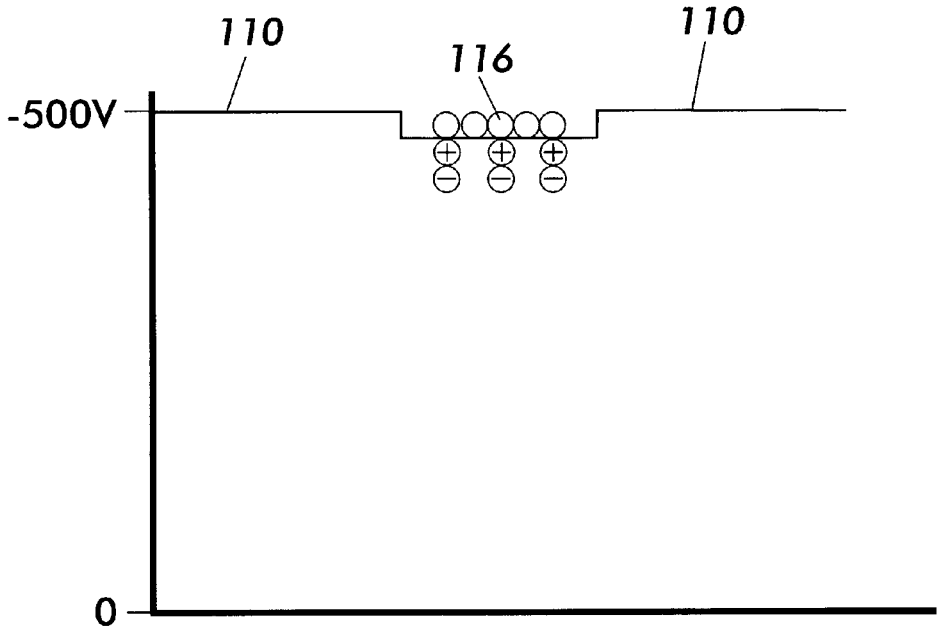

Preferably, DC charging device 36*a* is designed to recharge the image area to equal the desired level of −500 volts. However, high electric fields present inside toner layer 116 limit positive corona ions from getting into the layer. Thus, after passing charging device 36*a*, the surface potential of the untoned parts 110 and toned parts 114 of the image area are more or less uniformly charged to the desired potential of −500 volts. However, after passing charging device 36*a*, the bottom of toner layer 116 still retains a relatively large negative charge but the charge on the toner at the top of the layer will turn to the opposite sign (positive). The voltage profile of the image area after passing charging device 36*a* is shown in FIG. 5.

After passing direct current charging device 36*a*, the image area advances to AC charging device 36*b*. Beneficially, charging device 36*b* has a high operating slope such that a small voltage variation on the image area can result in large charging currents being applied. An exemplary high slope charging device is described in U.S. Pat. No. 5,581,330 to Pietrowski et al., the relevant portions of which are hereby incorporated by reference herein.

Grid 94 is maintained at a preestablished potential and serves to terminate charging of the image area when the potential on the surface of the image area reaches a predetermined level. This predetermined level can be precisely adjusted by varying the grid voltage in a known manner. The grid can be biased by means of external voltage source 98 as shown in FIG. 2, or it can be self biased from the corona current. Preferably, the predetermined level is adjusted to equal the desired potential (−500 volts) such that charging device 36*b* delivers current until the surface of the image area is equal to the desired level. With an alternating voltage from power source 100 applied to corona wire 92, device 36*b* delivers either positive or negative ions to the image area until the surface of the image area is charged to the desired level. Once the surface of the image area reaches the desired level, current flow to the image area is stopped and charging device 36*b* begins to supply both negative and positive ions to the image area.

Figure 6:
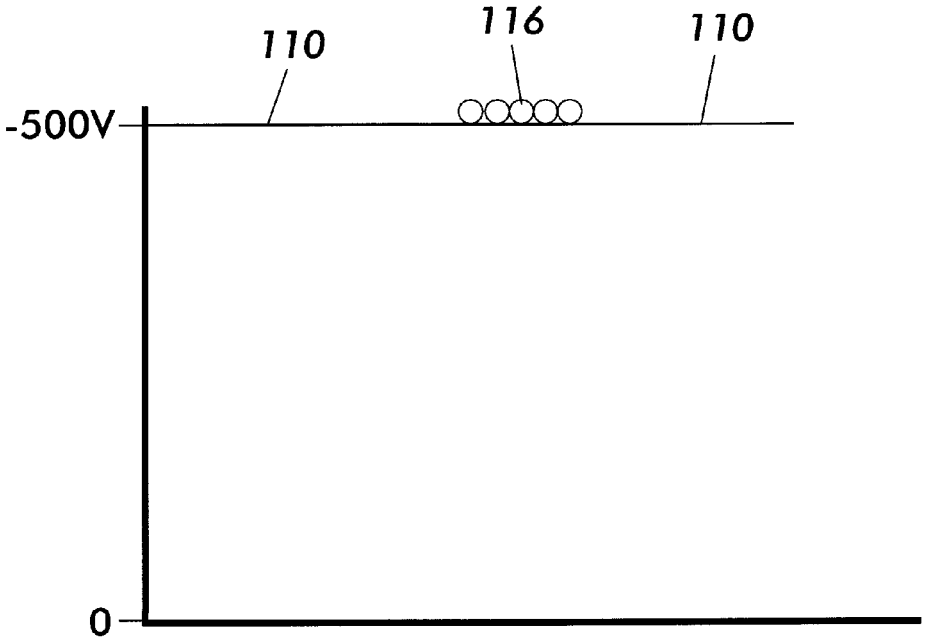

As DC device 36*a* has previously recharged the surface of the image area to equal or very nearly equal the desired potential, charging device 36*b* spends very little, if any, of the time that the image area is present charging the image area and spends the majority of the time showering the image area with both negative and positive ions. By showering the image area with both positive and negative ions, charging device 36*b* neutralizes the charge of the toner layer and ensures that the photoreceptor is uniformly charged. Furthermore, since AC device 36*b* delivers both positive and negative ions, the device will substantially neutralize the toner charge rather than simply change it to an opposite polarity. After passing AC charging device 36*b*, the residual toner voltage is neutralized and voltage uniformity between the toned parts 114 and untoned parts 110 of the photoreceptor is achieved. (FIG. 6).

While the foregoing description was directed to a discharged area development DAD image on image process color printer where a full color image is built in a single pass of the charge retentive surface, it will be appreciated that the invention may also be used in a charged area development CAD or CAD-DAD in both single pass or multiple pass systems, as well as in a single or multiple pass highlight color process machine. Furthermore, the present invention can be used in a high speed monochrome printer or color machine for any process where a high slope device is needed, such as for toner pretransfer treatment or for detaching paper from the photoreceptor after image transfer.

The high slope DC/AC charging device 36 of FIG. 2 has been described for purposes of example as comprising a DC corotron (DC charging device 36*a*) and a high slope AC discorotron (AC charging device 36*b*). However, it is understood that both DC charging device 36*a* and AC charging device 36*b* could also be in the form of other types of corona generating devices known in the art. For example, DC charging device 36*a* can comprise any direct current charging device with or without a grid or other type of voltage control surface known in the art such as a corotron, a pin corotron, a scorotron, a pin scorotron, or the like. Similarly, AC charging device 36*b* can comprise any AC charging device having a grid or other type of voltage control surface known in the art including, but not limited to, single wire or multi-wire scorotrons or discorotrons.

Figure 7:
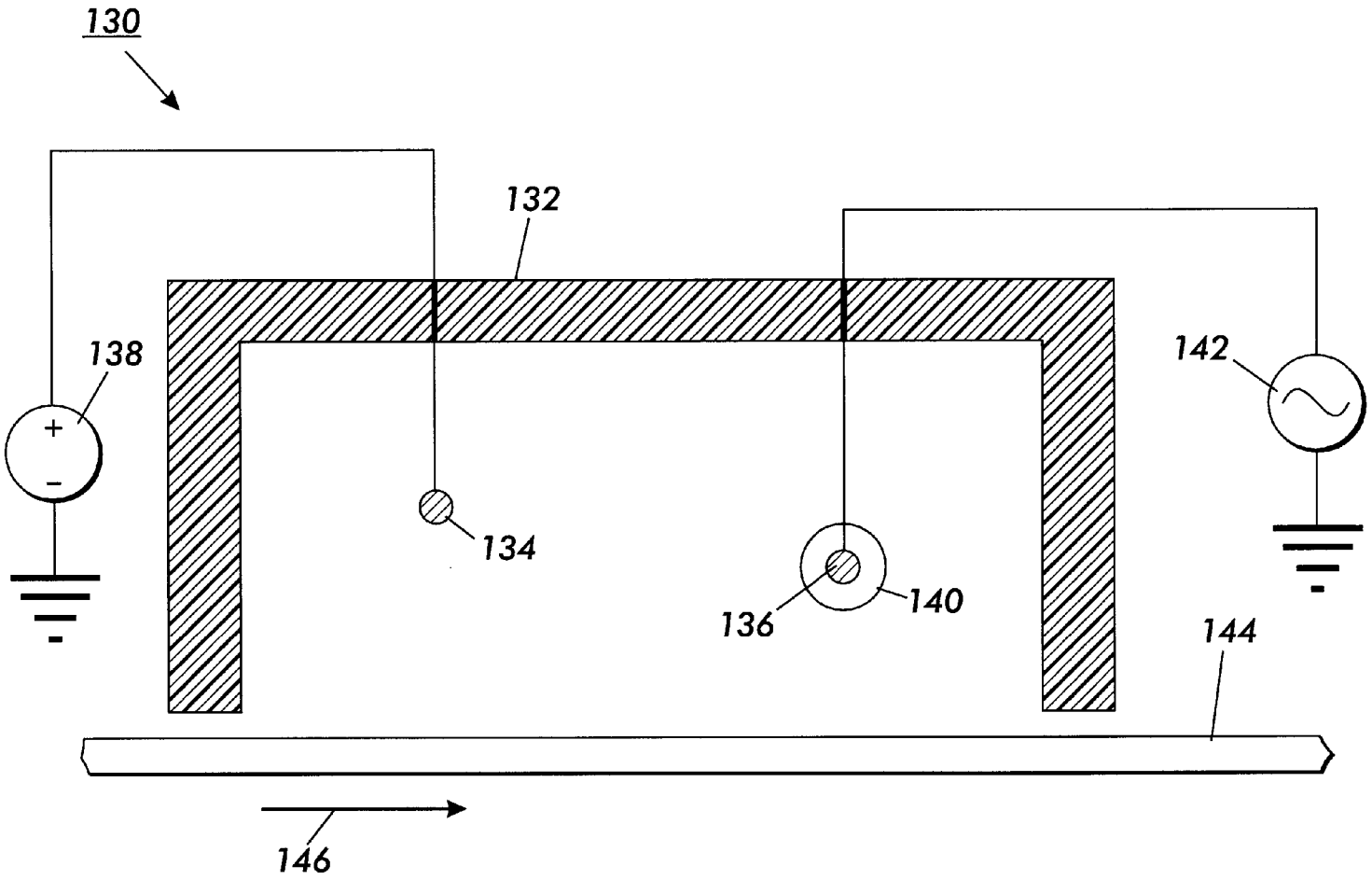
FIG. 7 is a sectional, elevational view illustrating a second embodiment of a charging apparatus in accordance with the principles of the present invention.

Turning now to FIG. 7, there is shown a high slope charging device 130 including a DC portion followed by an AC portion in accordance with the present invention. As shown, device 130 includes an insulative shell 132 housing electrode 134 and corona wire 136. Electrode 134 is coupled to direct current power source 138. Corona wire 136, which is beneficially coated with a dielectric material 140 such as glass, is coupled to alternating current power source 142.

In operation, power source 138 supplies a constant potential to electrode 134 thereby generating a corona at the electrode. Although electrode 134 is shown as comprising a corona wire, it is understood that electrode 134 could employ one or more pins to generate a corona in response to the potential from power source 138. Similarly, alternating current power source 142 supplies an alternating voltage to corona wire 136. Beneficially, charging device 130 is designed such that both electrode 134 and corona wire 136 charge surface 144 to the same potential.

As charge retentive surface 144 advances in the direction of arrow 146 past charging device 130, surface 144 first passes the DC portion of the charging device at which the surface is charged almost exclusively by ions generated by electrode 134. As electrode 134 showers down one kind of corona ions (e.g., positive) onto surface the all of the ions produced are used to quickly and efficiently charge surface 144 to a near uniform potential.

As surface 144 continues in the direction of arrow 146, the surface reaches a the AC portion of device 130 at which the surface is charged mainly by corona ions generated at corona wire 136. Because wire 136 receives an alternating voltage, wire 136 supplies both positive and negative ions to surface 144. At the AC portion, corona wire will deliver either positive or negative ions to surface 144 until the surface reaches a predetermined potential at which the AC portion (wire 136) begins to supply both negative and positive ions to the surface.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. An apparatus for recharging a charge retentive surface from an overcharged potential to a predetermined potential, said predetermined potential having a lower absolute potential than said overcharged potential, wherein said charge retentive surface includes a developed image having an electrical charge associated therewith, comprising:

a DC charging device, positioned adjacent said charge retentive surface, said DC charging device recharging said charge retentive surface to an intermediate potential, said intermediate potential having an absolute potential that is lower than the overcharged potential and greater than or equal to the absolute potential of the predetermined potential; and an AC charging device, positioned adjacent the charge retentive surface, the AC charging device recharging the charge retentive surface to the predetermined potential and substantially neutralizing the electrical charge associated with the developed image.

2. The apparatus according to claim 1, wherein said AC charging device comprises:

an electrode, said electrode being coated with a dielectric material;

an alternating current source coupled to said electrode; and a grid, interposed between said electrode and said charge retentive surface, said grid being biased to a grid potential, said grid controlling current flow from said electrode to said charge retentive surface in response to said grid potential.

3. The apparatus of claim 1, further comprising a corona generating device, spaced from said DC charging device and said AC charging device and positioned adjacent the charge retentive surface, said corona generating device recharging said charge retentive surface to said overcharged potential.

4. The apparatus according to claim 3, wherein said DC charging device charges the charge retentive surface to said predetermined potential.

5. The apparatus according to claim 4, wherein said DC charging device and said AC charging device are voltage sensitive.

6. An apparatus for recharging a charge retentive surface from an overcharged potential to a predetermined potential, said predetermined potential having a lower absolute potential than said overcharged potential, wherein said charge retentive surface includes a developed image having an electrical charge associated therewith, comprising:

a DC charging device, positioned adjacent said charge retentive surface, said DC charging device charging the charge retentive surface to said predetermined potential; and an AC charging device, positioned adjacent the charge retentive surface, the AC charging device recharging the charge retentive surface to the predetermined potential and substantially neutralizing the electrical charge associated with the developed image, said AC charging device including an electrode, said electrode being coated with a dielectric material; an alternating current source coupled to said electrode; and a grid, interposed between said electrode and said charge retentive surface, said grid being biased to a grid potential, said grid controlling current flow from said electrode to said charge retentive surface in response to said grid potential.

7. The corona generating apparatus according to claim 6, wherein said AC charging device is positioned adjacent said DC charging device.

8. A printing machine, comprising:

a charge retentive surface having a developed image thereon, the developed image having an electrical charge associated therewith;

a corona generating device, positioned adjacent the charge retentive surface, said corona generating device recharging said charge retentive surface to an overcharged potential, said overcharged potential having a greater absolute potential than a final potential;

a DC charging device, positioned adjacent said charge retentive surface, said DC charging device recharging said charge retentive surface to an intermediate potential, said intermediate potential having an absolute potential that is lower than the overcharged potential and greater than or equal to the absolute potential of said final potential; and an AC charging device, positioned adjacent said charge retentive surface, said AC charging device recharging said charge retentive surface to said final potential and substantially neutralizing the electrical charge associated with the developed image.

9. The printing machine of claim 8, wherein said corona generating device is spaced from said DC charging device and said AC charging device; and said AC charging device is positioned adjacent to said DC charging device.

10. The printing machine of claim 9, wherein said DC charging device and said AC charging device are voltage sensitive.

11. A device for charging a charge retentive surface, comprising:

a shell;

first and second electrodes housed within said shell;

a first power source, coupled to said first electrode, said first power source supplying a constant potential to said first electrode; and a second power source, coupled to said second electrode, said second power source applying an alternating voltage to said second electrode;

wherein said first electrode charges said charge retentive surface to a first potential and said second electrode charges said charge retentive surface to a second potential equal to said first potential.

12. The device according to claim 11, wherein said second electrode comprises a corona wire coated with a dielectric material.

13. The device according to claim 12, further including a grid, interposed between said second electrode and said charge retentive surface, said grid being biased to a grid potential, said grid controlling current flow from said second electrode to said charge retentive surface in response to said grid potential.

* * * * *